US005186369A

United States Patent [19]

Aguirrezabal

[11] Patent Number: 5,186,369

[45] Date of Patent: Feb. 16, 1993

[54] TUBULAR CONTAINER WITH NON-REMOVABLE WORKING CAP

[75] Inventor: Antonio Aguirrezabal, Vitoria, Spain

[73] Assignee: Tuboplast Hispania, S.A., Vitoria, Spain

[21] Appl. No.: 558,589

[22] Filed: Jul. 27, 1990

[30] Foreign Application Priority Data

Jul. 28, 1989 [ES] Spain ..... 8902675
Jan. 22, 1990 [ES] Spain ..... 9000179

[51] Int. Cl.[5] ..... B65D 47/28
[52] U.S. Cl. ..... 222/521; 222/519
[58] Field of Search ..... 222/153, 519–521

[56] References Cited

U.S. PATENT DOCUMENTS

| | | | |
|---|---|---|---|
| 1,497,617 | 6/1924 | Tschiffely | 222/520 |
| 2,146,993 | 2/1939 | Schroeder | 222/520 |
| 2,307,224 | 1/1943 | Kingman | 222/519 X |
| 2,915,227 | 12/1959 | Quint | 222/519 |
| 3,175,741 | 3/1965 | Porter | 222/521 |
| 3,240,404 | 3/1966 | Porter et al. | 222/521 |
| 4,358,031 | 11/1982 | Lohrman | 222/521 X |
| 4,477,002 | 10/1984 | Stull | 222/521 |
| 4,807,807 | 2/1989 | Perne et al. | 222/521 X |
| 4,867,354 | 9/1989 | Schreiber | 222/521 |
| 4,964,548 | 10/1990 | Kenyon, Jr. | 222/521 |

FOREIGN PATENT DOCUMENTS

| | | | |
|---|---|---|---|
| 0296004 | 12/1988 | European Pat. Off. | 222/520 |
| 1485349 | 6/1967 | France | 222/519 |

*Primary Examiner*—Kevin P. Shaver
*Attorney, Agent, or Firm*—Browdy and Neimark

[57] ABSTRACT

A container endowed with a tube (6) and a cap (1) screwed to a neck of the tube has the inside of the threaded neck is provided with a lug (8) in communication with the inside of the tube. The lug is blind, and conduits leading to the outside are placed between the lug and the neck. The cap has a longitudinal inside tongue (4) projecting from the wall, having a spiral outer surface whereby the tongue may or may not be in contact with a lug (3) outside of the cap. A wall-stop (29) may top the vertical lug (21) at the top of the tube, preventing the cap from opening further.

5 Claims, 3 Drawing Sheets

TUBULAR CONTAINER WITH NON-REMOVABLE WORKING CAP

FIELD OF THE INVENTION

The present invention relates to tubular containers with non-removable working caps.

BACKGROUND OF THE INVENTION

In the field of tubular containers that dispense pasty products such as creams and similar materials, containers are known that are endowed with the property of having a cap and container body, both parts being screwed together, the cap having at least one hole so that, by screwing or unscrewing, the outlet for the product can be alternatively closed or opened to permit the product to discharge through the cap.

Some known cover caps of this type are composed of three parts, i.e. the tube, a middle part screwed to a neck, and the main cap part, wherein action between the main cap part and the middle component allows the product to discharge through at least one hole on the outside surface of the cap. The problems of this type of container derive primarily from the price, the fact that there are three components, and the possibility of easily releasing the connection between the components, which means that the cap is too easily removable.

Other covers of this type are also known having only two components, one being a tube having a specially-threaded neck, and a cap also having a specially-threaded step. To close the cap, considerable force is required to surpass the interconnection of said two special threadings and to close the outlet conduit of the neck and the cap. In these containers, to open the cap the latter is turned in the opposite direction, with the additional disadvantage that the cap can be disconnected from the tube.

SUMMARY OF THE INVENTION

The invention solves the problems which exist in these traditional techniques, based on a two-component unit which is inexpensive and easy to implement, while preventing the cap from being removed because the cap is broken if an attempt is made to do so.

The container of the present invention is endowed with two components, one being the conventional tube containing the product, and the other, a cap. The end of the tube has an externally-threaded neck that tops a truncated taper in such end. The inside of the neck is provided with a transverse wall having holes though which the product is discharged from the tube. A prominent cylindrical lug topped by an upper truncated portion projects from the center of the transverse wall.

The outside configuration of the cap is of a conventional general design and has an outside flap that adjusts to the outside of the tube. It is further provided with two additional walls or flanges or flaps, one threaded flange being connected to the threaded neck of the cap, and the other being parallel thereto and smaller, coming into contact with the inside of the threaded tube neck.

The cap also has a slightly concave outer frontal area extending along the inside of the inner space provided by the smaller inside wall or flange. This concave frontal area is provided with a central truncated hole of similar dimensions, identical to those of the central point of the tube, so that when the cap is screwed tight, the truncated end of the tube penetrates completely into the truncated hole, closing the hole and preventing the product from being discharged. On the contrary, when the cap is partially unscrewed, the hole in the cap is opened and the product may flow through the openings in the wall of the tube neck.

Additional characteristics of the present invention are as follows:

A vertical lug is placed in the conical area of the cap just below the beginning of the threaded part of the neck. This lug is interrupted a distance from the outside of the tube, its transverse section is approximately rectangular, and one of its surfaces is inclined. Due to this inclination, the outer part of the lug is thicker, and the inner part is thinner, this surface being inclined in the counterclockwise direction.

The cap comprises a flexible tongue stemming from the inside of the outer flange, forming a body with the flap of the cap itself and extending into a space graduated towards the theoretical inside of the cap and approximately spiral in shape.

The tongue stems from the inside of the flange in the counterclockwise direction, which is conventional and normal for closing a threaded area of the cap on the threaded tube neck. In this way, when closing the cap on the tube in clockwise direction, the vertical lug of the tube allows the tongue to slide and flex on the outside of the vertical lug until total closing occurs. Once this closing occurs, the shorter flange inside the cap has virtually abutted against the base of the transverse wall, and at the same time the truncated hole in the top of the cap has received the truncated end protruding from the tube neck.

In this closed position, the product inside the tube cannot be discharged, and the tongue is in a position diametrically opposite that of the lug of the tube. To open the cap, it is turned in the opposite direction so that the tongue rotates a few degrees from its initial position, until the interval between the hole in the cap and the lug of the threaded tube neck opens, and until the top of the tongue comes into contact with the lug of the tube, specifically with the inclined surface thereof stopping the rotation. If an attempt is made to force the cap in the opening direction once this point is reached, the stop may cause the tongue to break.

A constructive variation of the above consists in adapting the container to be discharged through circularly-arranged holes in the top of the cap. In this case, the diameter of the central projection on the inside of the tube neck is larger, and the central projection is endowed with circularly-arranged holes corresponding with those of the cap. In this case, the center of the central projection or cap neck is closed and slightly convex in its outer part, and the frontal inside surface of the cap has a small recess to receive such cap neck.

To open the cap and to facilitate the discharge of the product, the rotation of the cap causes the holes in the cap and the tube to coincide. On the other hand, for closing the holes do not coincide and the top of the cap comes into contact with the tube cap neck.

Conversely, it has been found in practice that, for certain caps, the inclination of the tube lug surface is insufficient to hold the cap, and for various reasons it sometimes gives way and the tongue and cap can continue to open with no effective stop between them, the position of the holding lug being surpassed. This situation can also occur when the cap is endowed with more than one tongue and the tube has more than one corresponding lug.

These negative circumstances are eliminated completely by another embodiment of the present invention. According to said possibility, the formal characteristics of the lug or stop provided in the tube are modified to create lateral parallel and flat surface means and a bent end extended in the clockwise direction.

The outside surface of this bent end catches a rounded circular component on which the tongue of the cap flexes when the cap is closed from the open container position. When the stop has been completely surpassed, the tongue returns to its initial position so that when the cap is rotated in the opposite direction, the top of the tongue remains in the inside surface of the bend which supplies a solid base with adequate resistance to continued opening.

The stop is consequently suitable for any application and operates with greater reliability and security.

As demonstrated, a container endowed with a tongue-stop according to the present invention opens and closes the space between the cap and the tube perfectly in order to facilitate the discharge of the product, or not, and provides an effective stop that lets the user know when the opening has been completed, so as not to force said opening unnecessarily. A container having these characteristics has a long useful life under perfect operating conditions.

BRIEF DESCRIPTION OF THE DRAWINGS

All of these and other details are shown on the accompanying diagrams, wherein.

DETAILED DESCRIPTION OF THE PREFERRED EMBODIMENTS

Figure 1:
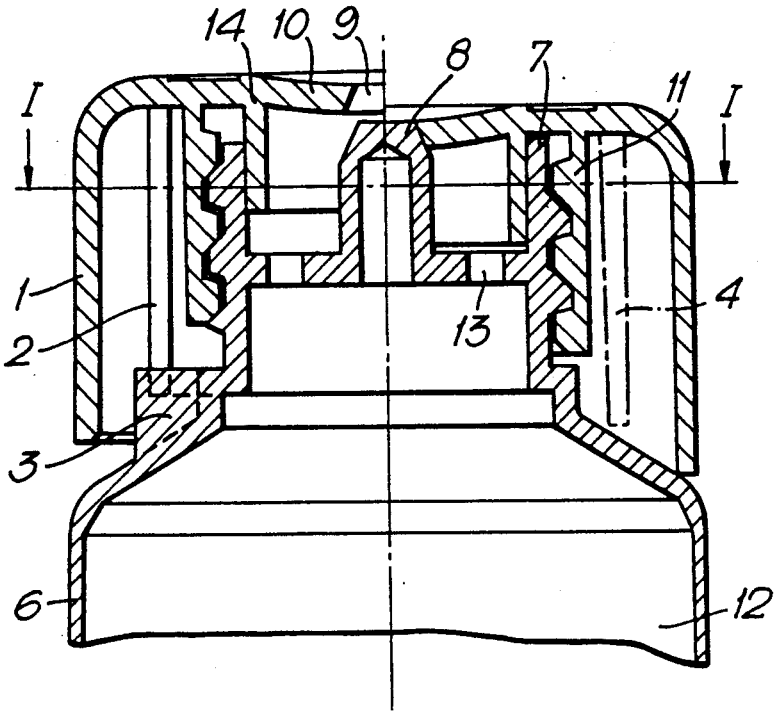
FIG. 1 is a front sectional view of the container, shown in two parts, with the cap open and with the cap closed.

FIG. 1 shows a container having a cap (1) and a tube (6). The tube (6) is provided with a lateral lug (3) having a shoulder stop and a threaded neck (7) from the inside of which protrudes a stopper lug or boss (8) with truncated top, whose base contains holes (13) for the product to pass from the inside (12) of the tube to the outside. On the left side, cap (1) is shown in open position to discharge the product, and the cap is in closed position on the right. The outside flap or flange, threaded flap or flange (11) and the inside or flange (14) can be seen. On the left side, hole (9) in top (10) of the cap is open a distance from the top of the stopper lug (8), allowing the product to be discharged. Conversely, the right side shows that cap (1) is screwed almost completely to the neck (7) of the tube, hole (9) being closed by the stopper lug (8).

Figure 2:
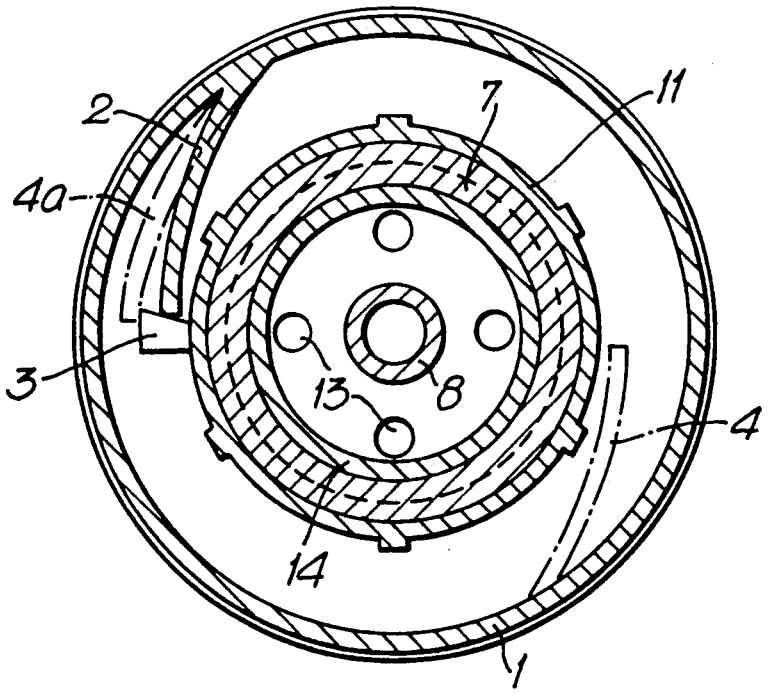
FIG. 2 shows section I—I in FIG. 1.

FIG. 2 shows the lug (3) (having a shoulder stop) of the tube with its left inclined surface and the inside flexible tongue (2) of cap (1). The tongue (2) is shown at the right in position (4) when the capsule is closed, and in deflected position (**4*a*) when the capsule is open, wherein the lug (3) is surpassed to reach position (2) against the inclined shoulder stop of the lug (3**).

Figure 3:
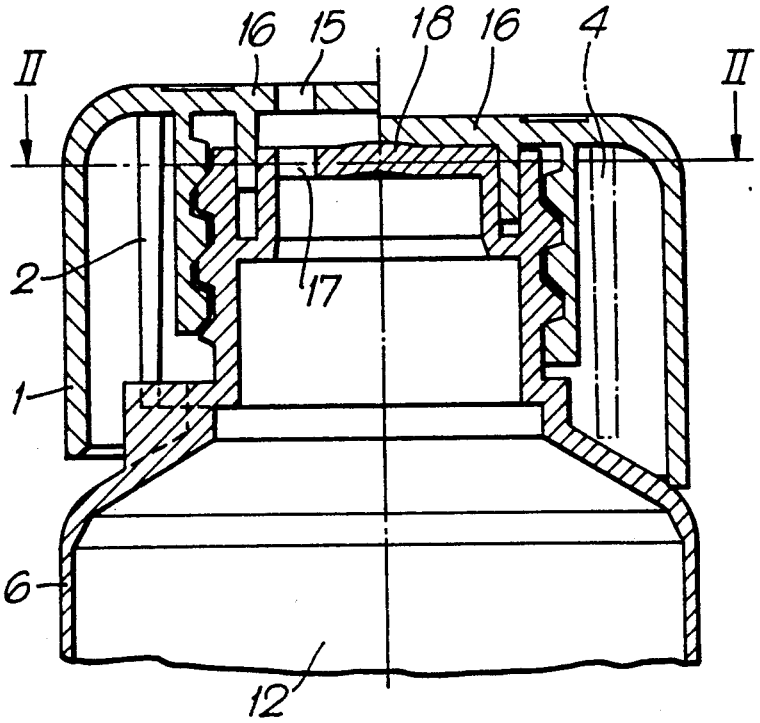
FIG. 3 is a front section view of a variation of the container.

FIG. 3 shows the constructive variation of the container, wherein the part of the cap (1) which is on the neck of the tube (6) has an inside central portion (18) closed in its center and convex in its upper part, its sides containing holes (17) opposite holes (15) in the top of cap (1). In closed position (right side of FIG. 3), holes (15) and (17) do not align, as shown.

Figure 4:
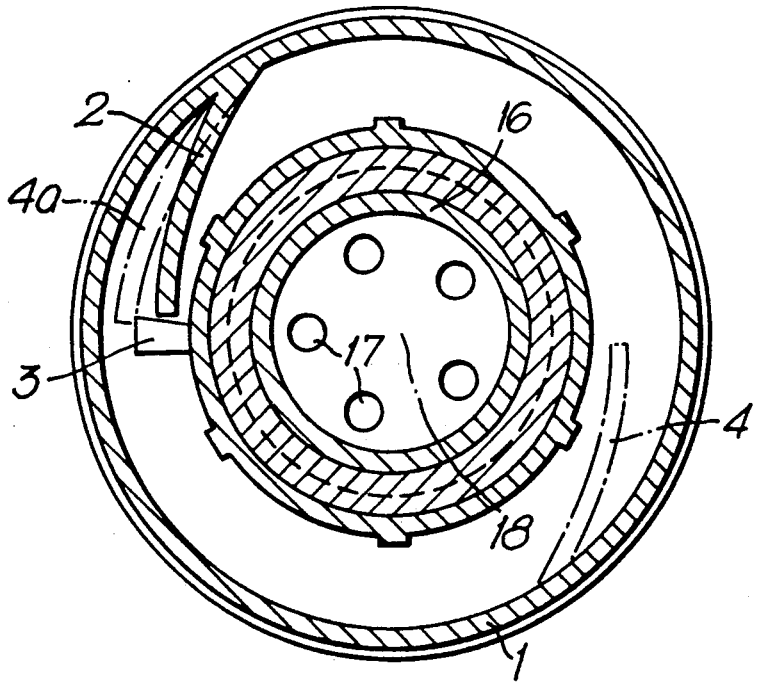
FIG. 4 shows section II—II in FIG. 3.

Section II—II of said FIG. 3, shown in FIG. 4, depicts the flexible tongue (2) in closed position (4) at the right, and in phantom in deflected position (**4*a*) close to its position against shoulder stop (3) at the left. Center (18) of the cap, its area (16) and holes (15**) for the discharge of the product can also be seen.

Figure 5:
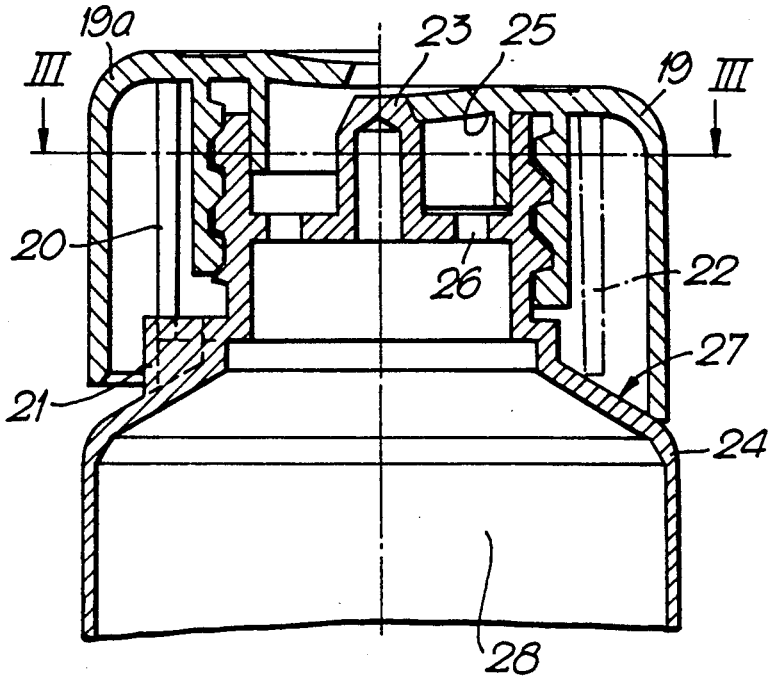
FIG. 5 is a front double diametric section view of a container including the stop, showing the cap in open and closed positions.

FIG. 5 shows a container composed of a tube (24), having an upper truncated area (27), a threaded neck (unnumbered) projecting upward therefrom, surrounding a cavity. The bottom of this cavity contains a series of step-like holes (26) that connect the inside (28) of the tube (24) with the outside for the discharge of the product stored in tube (24) through a hole in cap (19).

Boss or stopper lug (23) protrudes from the center of the aforementioned cavity, said boss having a truncated top which enters the hole in the cap, as shown in the right half of FIG. 5. In this position, the product cannot escape to the outside because the boss (23) has entered the hole in the cap and upper chamber (25) is closed.

On the other hand, the left side in FIG. 5 shows how in the open position the product on the inside (28) of tube (24) passes through perforations (26) to chamber (25), and then to the outside. In this area, the cap is labelled (**19*a*), and flexible tongue (20) and stop (21**) are also shown.

Figure 6:
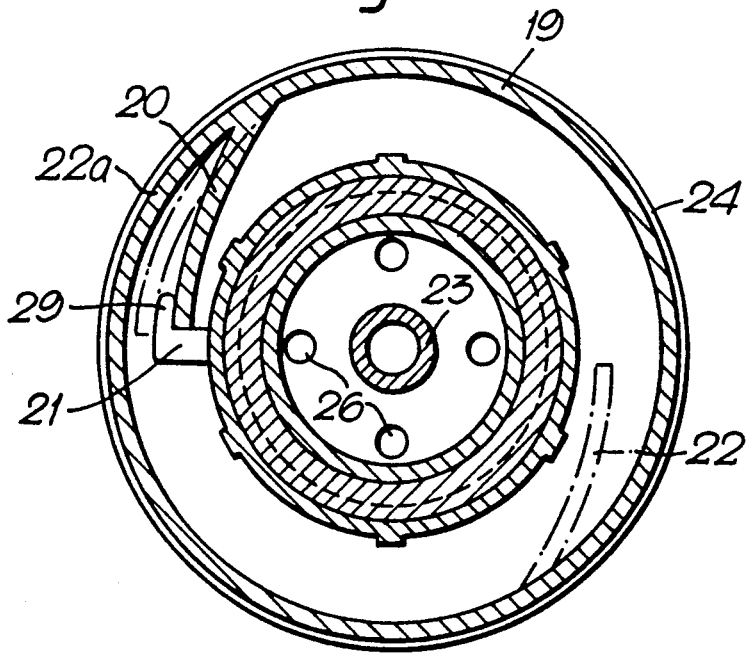
FIG. 6 corresponds to the view along cut III—III in FIG. 5.

FIG. 6 shows the container with the cap open for product discharge, with two additional positions (22) and (**22*a*) respectively indicating the tongue in position with container closed, and the tongue in its deflected position surpassing stop (21) of the tube. Of course, in the container's normal position, tongue (20) of cap (19**) is in said closed position. In this case, the cap and tube have an opening of approximately 180° depending on the type and weight of the corresponding threading in both components.

To open the container, the cap (19) is turned to the left counterclockwise with tongue (20) open, so that in said rotation the tongue is in position (20) duly lodged in lug (21) and held in by the bend portion (29) of the stop.

FIG. 6 also shows that, in a specific position and for a type of container, tongue (**22*a*) flexes on unit (21)–(29**) in closed position.

Three different positions of the cap tongue have thus been defined in relation to the tube and with the lug-stop thereof, i.e., tongue free (22), tongue (**22*a*) flexing on lug (21)–(29) and tongue (20) lodged inside (21)–(29**).

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A tubular container with a non-removable working cap, wherein said cap is breakable if an attempt is made to remove the cap, comprising:

a tube (6) having a threaded neck (7), an outlet from the tube for the passage of a product from inside of said tube, and a cap screwed to said neck; said cap having at least one hole to allow the product to be discharged from the tube;

a lug (3) vertically disposed on a truncated portion of tube (6) under the threaded neck (7) that forms a frontal outside zone that is interrupted a distance from a lateral outside surface of the tube, a second zone disposed counterclockwise that forms a right angle from said first zone, and a third zone clockwise of said first zone that forms an acute angle with said first zone;

said outlet from the tube comprising a number of circularly-arranged holes (13) projecting from an inside bottom of said threaded neck of said tube;

a boss (8) disposed on an inside bottom of said threaded neck of said tube;

said cap having a lower surface that serves as a point of downward departure for one cylindrical flange (14) having a small diameter and height and lodged inside of the neck of said tube; another cylindrical flange (11) having a greater diameter and height than flap (14) and threaded to neck (7), and a third outside cylindrical flap having a height greater than flange (11) and having a diameter that coincides with an outside diameter of the tube; and a tongue (2) having a helicoidal component that originates from the lower surface of said cap between the another and third flanges and from an inside surface of said third flange in a counterclockwise direction; said tongue having a height smaller than that of the outside flap of said cap, and slightly surpassing lug (3).

2. The tubular container with a non-removable working cap of claim 1, wherein said hole (9) in said cap is truncated and centered, and said boss (8) disposed inside said threaded neck of said tube is topped with a truncated end that corresponds with an end of said cap.

3. The tubular container with a non-removable working cap of claim 1, wherein said at least one hole of said cap consists of a number of circularly-arranged holes (15), said boss (18) disposed on the inside of the neck of said tube is convex in an upward direction and contains holes (17) coincidable with holes in said cap when in an open position, and in which said convex boss (18) is in contact with said lower surface of said cap when in a closed position.

4. The tubular container with a non-removable working cap of claim 1, wherein said vertical lug (21) of said tube has a stop (29) extending from its frontal outside surface in a clockwise direction, and constitutes an angular housing for tongue (20).

5. The tubular container with a non-removable working cap of claim 4, wherein said stop (29) has a carved outer surface.

* * * * *